US005846136A

United States Patent [19]

Wu

[11] Patent Number: 5,846,136

[45] Date of Patent: Dec. 8, 1998

[54] SWING CHAIR

[76] Inventor: Sung-Tsun Wu, 8F-1, No. 249, Chung Ching Road, Pan Chiao City, Taipei Hsien, Taiwan

[21] Appl. No.: 15,800

[22] Filed: Jan. 29, 1998

[51] Int. Cl.[6] ..... A63G 9/16

[52] U.S. Cl. ..... 472/119; 74/48

[58] Field of Search ..... 472/118, 119, 472/125; 185/37, 38, 39, 40 R, 40 C; 74/25, 48

[56] References Cited

U.S. PATENT DOCUMENTS

| | | | |
|---|---|---|---|
| 2,564,547 | 8/1951 | Schrougham | 472/119 |
| 3,804,407 | 4/1974 | Saint | 472/119 |
| 4,165,872 | 8/1979 | Saint | 472/119 |
| 4,323,233 | 4/1982 | Gebbard | 472/119 |
| 5,083,773 | 1/1992 | Saint | 472/119 |
| 5,525,113 | 6/1996 | Mitchell et al. | 472/119 |

*Primary Examiner*—Kien T. Nguyen

[57] ABSTRACT

A swing chair includes a frame structure having a rectangular base constituted by four bar members defining two rear corners and two front corners and two standing bar members respectively extending upward from two rear corners and inclining toward the front corners with a space between the two standing bar members. Each of the standing bar members has an axle extending therefrom toward each other in a co-linear manner, the axle having a pendent arms rotatably mounted thereto and extending downward therefrom to define a lower end. A chair is positioned in the space between the two standing bar members and attached to the lower ends of the pendent arms so as to be rotatable or swingable about the axles. One of the standing bar members has a swing drive mechanism fixed to the top end thereof. The drive mechanism includes a motor coupled to the axle of the standing bar member by a worm and worm gear pair. The worm gear has an eccentric pin. The axle has a link member mounted thereto and the link has an elongated slot into which the eccentric pin is movably received so as to convert the rotation of the motor into the reciprocal rotation of the axle which in turn drive the pendent arm to swing.

10 Claims, 7 Drawing Sheets

SWING CHAIR

FIELD OF THE INVENTION

The present invention relates generally to a swing chair for young children and in particular to a swing chair having a simplified swinging drive mechanism.

BACKGROUND OF THE INVENTION

Swing chairs are a common device for young children. Most of the swing chairs have two pendent arms rotatably mounted to an overhead cross bar which is usually fixed to for example walls or other similar fixtures and extending downward therefrom. A chain is fixed to the lower ends of the pendent arms for receiving and holding a child therein. By means of the rotatable connection between the pendent arms and the cross bar, the chair is rotatable or swingable about the cross bar. Such a conventional design requires a cross bar to support the chair and at such a situation where there is no space available for accommodating the cross bar or there is no fixture to support the cross bar, it is not able to install the swing chair.

To overcome such a problem, an open top swing chair has been suggested, which comprises two spaced support frames, each having a horizontal axle co-linear with each other and each axle having a pendent arm rotatably supported thereon and extending therefrom. A chair is attached to the lower ends of the arms. Such an arrangement requires no overhead cross bar. Examples of the open top swing chair include U.S. Pat. Nos. 5,525,113 and Des. 368,816.

The swing chair disclosed in U.S. Pat. No. 5,525,113 is provided with a multiple speed and multiple swing height control. However, such a control and drive mechanism is very complicated which makes the mechanism easy to break down and difficult to maintain. Further, such a complicated mechanism also requires a higher manufacture cost.

Thus, it is desired to have an open top type swing chair which is simple in both structure and drive mechanism so as to enhance manufacture, maintenance and repairing, use and sale.

SUMMARY OF THE INVENTION

Therefor, an object of the present invention is to provide a swing chair which has a simplified control/drive mechanism so as to reduce the likelihood of malfunction and also lower down the manufacture cost and increase market competitivity.

Another object of the present invention is to provide a swinging chair wherein the two spaced support members that support the chair are interconnected by bottom cross bars so as to provide a more secure structure.

To achieve the above objects, in accordance with the present invention, there is provided a swing chair comprising a frame structure having a rectangular base constituted by four bar members defining two rear corners and two front corners and two standing bar members respectively extending upward from two rear corners and inclining toward the front corners with a space between the two standing bar members. Each of the standing bar members has an axle extending therefrom toward each other in a co-linear manner, the axle having a pendent arms rotatably mounted thereto and extending downward therefrom to define a lower end. A chair is positioned in the space between the two standing bar members and attached to the lower ends of the pendent arms so as to be rotatable or swingable about the axles. One of the standing bar members has a swing drive mechanism fixed to the top end thereof. The drive mechanism comprises a motor coupled to the axle of the standing bar member by means of a worm and worm gear pair. The worm gear has an eccentric pin. The axle has a link member mounted thereto and the link has an elongated slot into which the eccentric pin is movably received so as to convert the rotation of the motor into the reciprocal rotation of the axle which in turn drive the pendent arm to swing.

BRIEF DESCRIPTION OF THE DRAWINGS

The present invention will be better understood from the following description of a preferred embodiment thereof with reference to the attached drawings, wherein.

DETAILED DESCRIPTION OF THE PREFERRED EMBODIMENT

Figure 1:
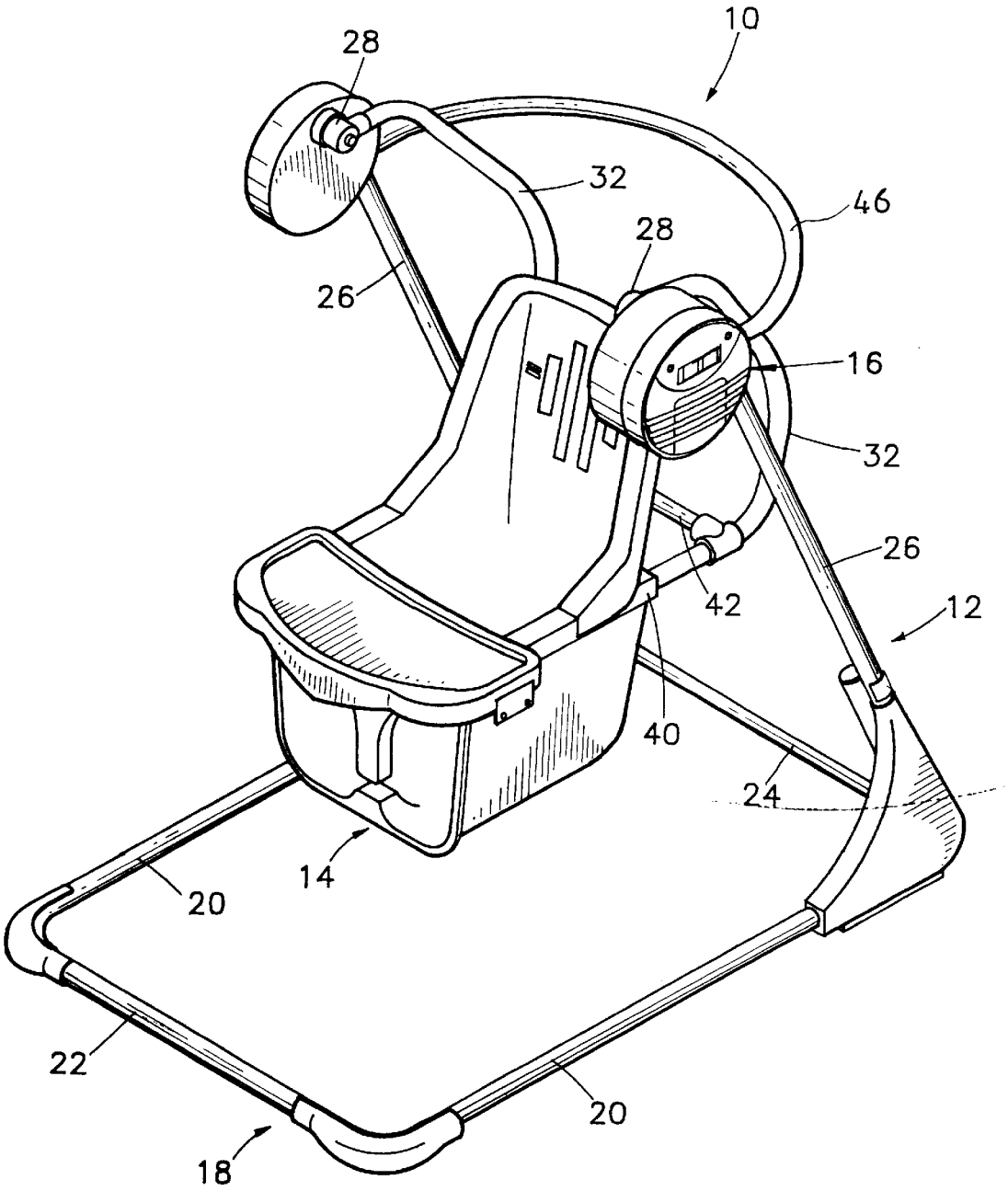
FIG. 1 is a perspective view showing a swing chair constructed in accordance with the present invention.
Figure 2:
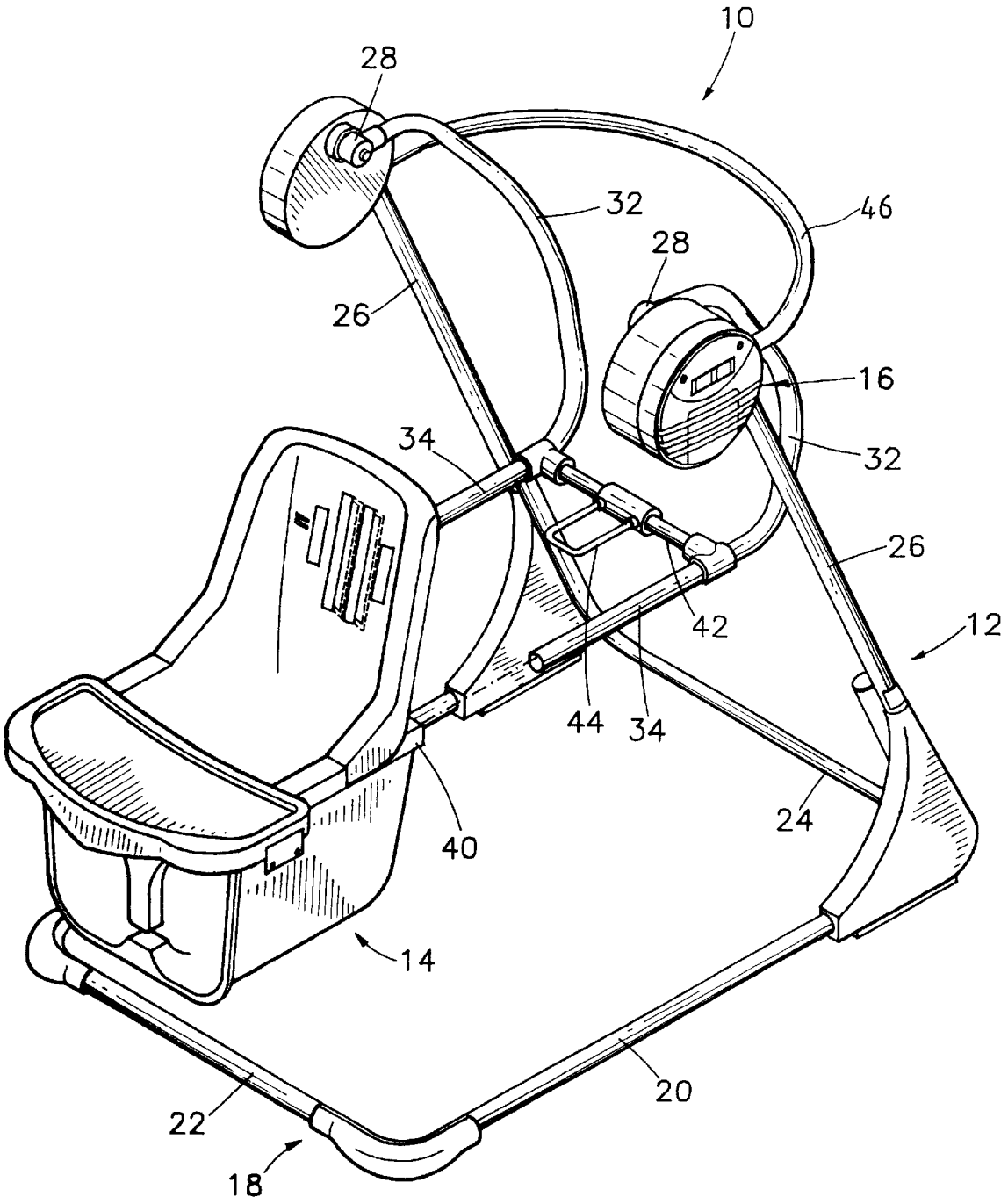
FIG. 2 is also a perspective view of the swing chair in accordance with the present invention, with the chair detached from the support frame.
Figure 3:
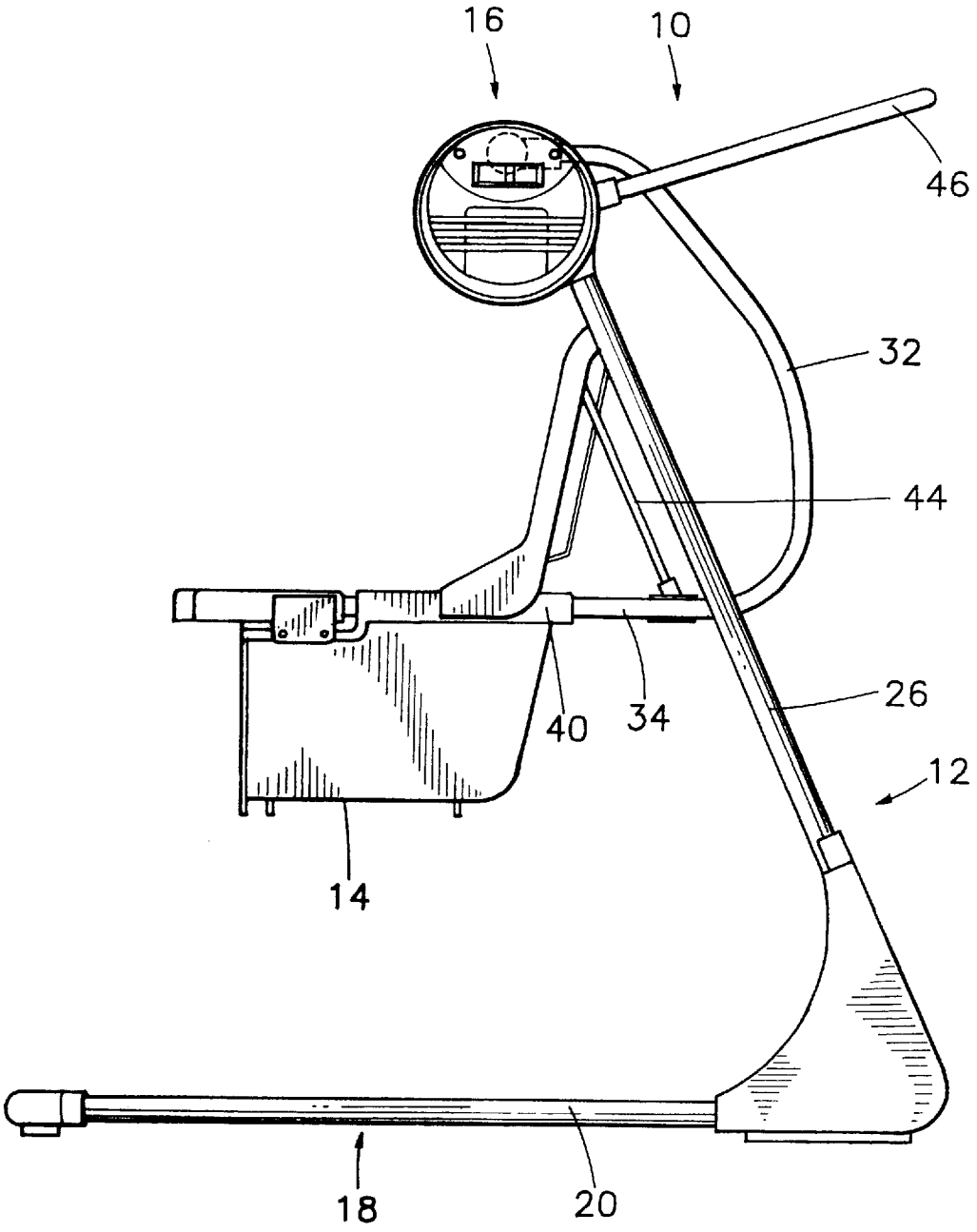
FIG. 3 is a side elevational view of the swing chair in accordance with the present invention, showing the chair in a neutral position.

With reference to the drawings and in particular to FIGS. 1, 2 and 3, wherein a swing chair constructed in accordance with the present invention, generally designated at 10, is shown; the swing chair 10 comprises a frame structure 12 and a chair 14. The chair 14 is sized to receive and hold a young child (not shown) therein and is rotatably supported on the frame structure 12 by means of a swing drive mechanism 16 so as to allow the chair 14 to be reciprocally swingable between a forward swung position and rearward swung position with respect to the frame structure 12 by being driven by the drive mechanism 16.

The frame structure 12 comprises a bottom base framework, which is substantially rectangular, constituted by two side bar members 20 and a front bar member 22 and a rear bar member 24. The front and rear bar members 22 and 24 are respectively connected to and between front ends and rear ends of the side bar members 20 so as to define two front corners forming joints between the side bar members 20 and the front bar member 22 and two rear corners forming joints between the side bar members 20 and the rear bar member 24. A standing bar member 26 extends upward from each of the rear corners and preferably inclined toward the front corner so that top ends of the standing bar members 26, when viewed from the top side, are preferably located midway between the front and rear corners and define a mirror symmetry with respect to each other. The standing bar members 26 are spaced from each other so as to leave a spacing therebetween for accommodating the reciprocal movement of the chair 14 therein.

Each of the standing bar members 26 has an axle 28 having a bearing 27 mounted thereon and extending in a transverse direction from the top end thereof and the axles 28 of the two standing bar members 26 are aligned with each other and thus co-linear to define a rotational axis about which the chair 14 is that is rotatably supported on the standing bar members 26 of the frame structure 12. The swing drive mechanism 16 is mounted to the top end of one of the standing bar members 26 which is coupled to the chair 14 by means of a transmission system (see FIGS. 6, 7 and 8) and the bearings 27 so as to rotate or swing the chair 14 about the rotational axis 28.

In accordance with the present invention, the two standing bar members 26 of the frame structure 12 are arranged to extend from the rectangular bottom base 18 of the frame structure 12 in a manner to be substantially parallel with each other, as shown. Alternatively, the two standing bar members 26 may also be arranged to be inclined toward each other so that, for a given size of chair 14, the bottom base framework 18 has to be enlarged which provides a more stable support of the chair 14 and thus reduces the likelihood of accident caused by over-swinging of the chair 14.

As shown in FIGS. 2 and 3, the axle 28 of each of the standing bar members 26 has a pendent arm 32 extending downward therefrom. In the embodiment illustrated, the arm 32 is an arc member so that a chair attaching section 34 of the arm 32 is substantially horizontal when the arm 32 is in a neutral position (FIG. 3) between the forward swung position and rear swung position. The chair 14 is provided with two slots 40 on two opposite sides thereof to receive the chair attaching sections 34 of the arms 32 therein so as to mount the chair 14 to the arms 32. Preferably, a cross bar 42 is provided and interconnected between the two arms 32 so as to secure the two arms 32 together. A releasable fastener 44 is provided to fasten the chair 14 on the arms 32 and in the embodiment illustrated, the fastener 44 is mounted on the cross bar 42. The fastener 44 comprises a U-shaped section (FIG. 2) which is receivable within an engaging slot on the chair 14 (FIG. 3) to releasably secure the chair 14 on the arms 32.

Preferably and selectively, a further cross bar 46 is provided to connect between top ends of the standing bar members 26 for securing the top ends of the standing bar members 26 together.

Figure 4:
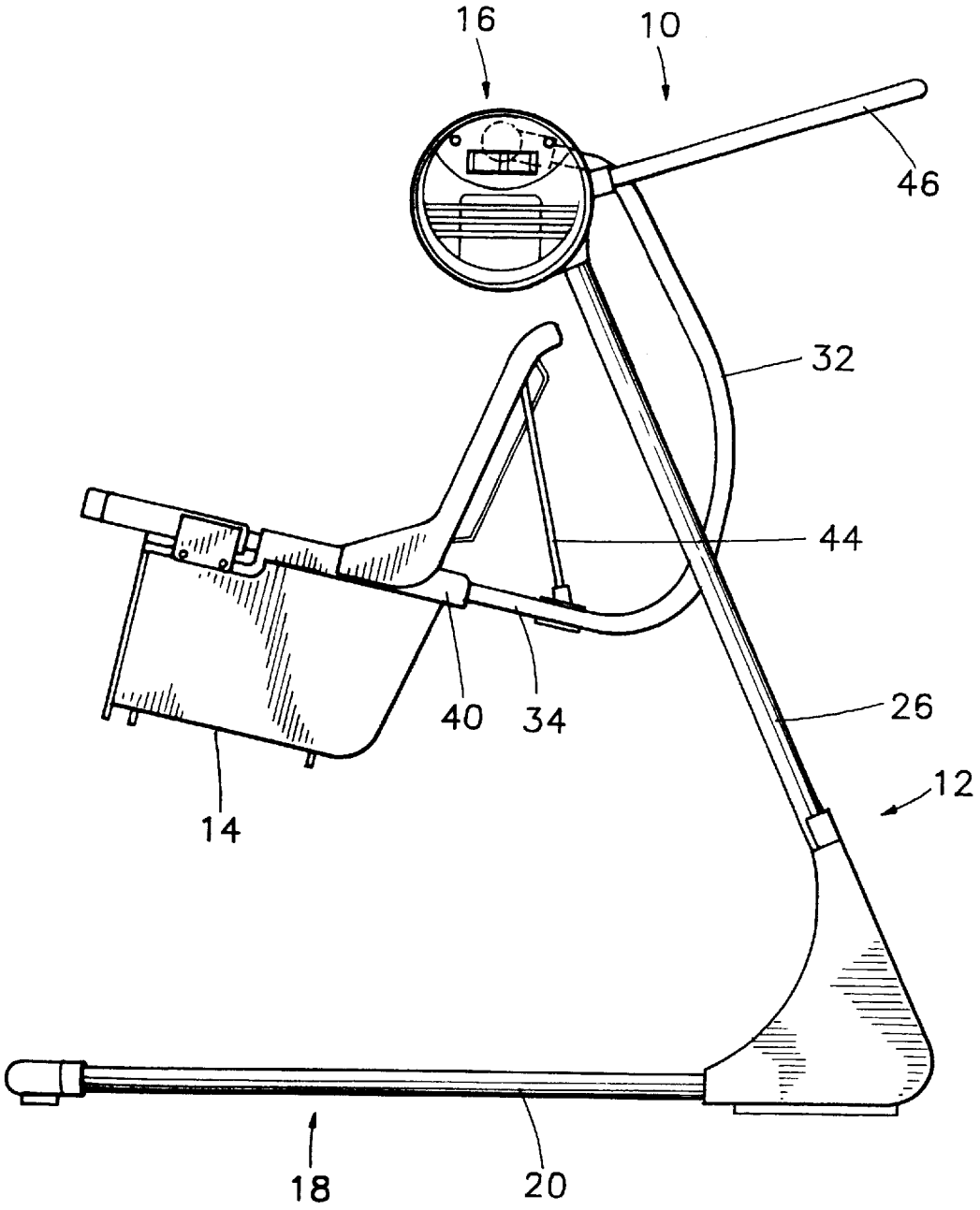
FIG. 4 is also a side elevational view of the swing chair in accordance with the present invention, showing the chair in a forward swung position.
Figure 5:
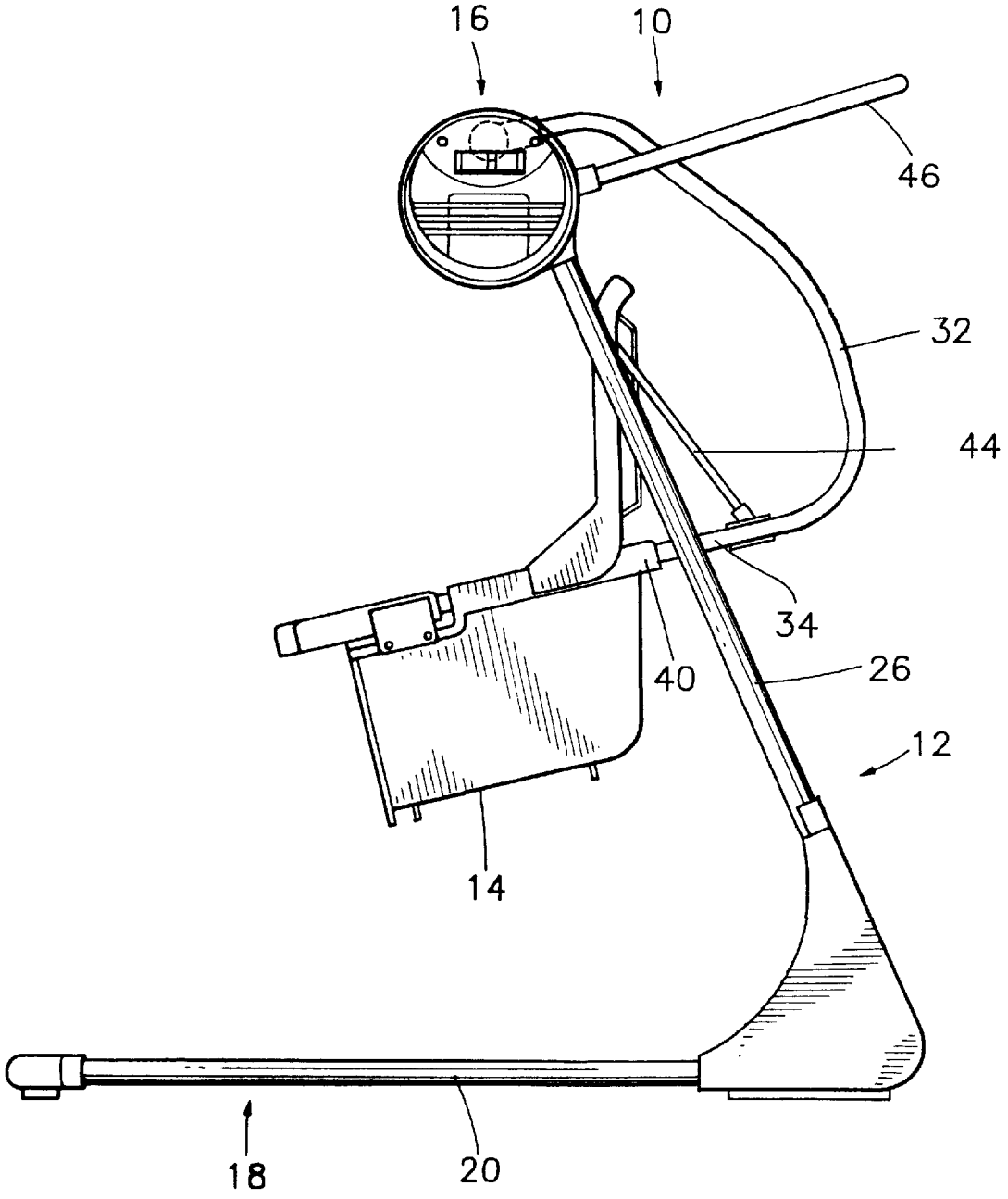
FIG. 5 is also a side elevational view of the swing chair in accordance with the present invention, showing the chair in a rearward swung position.
Figure 6:
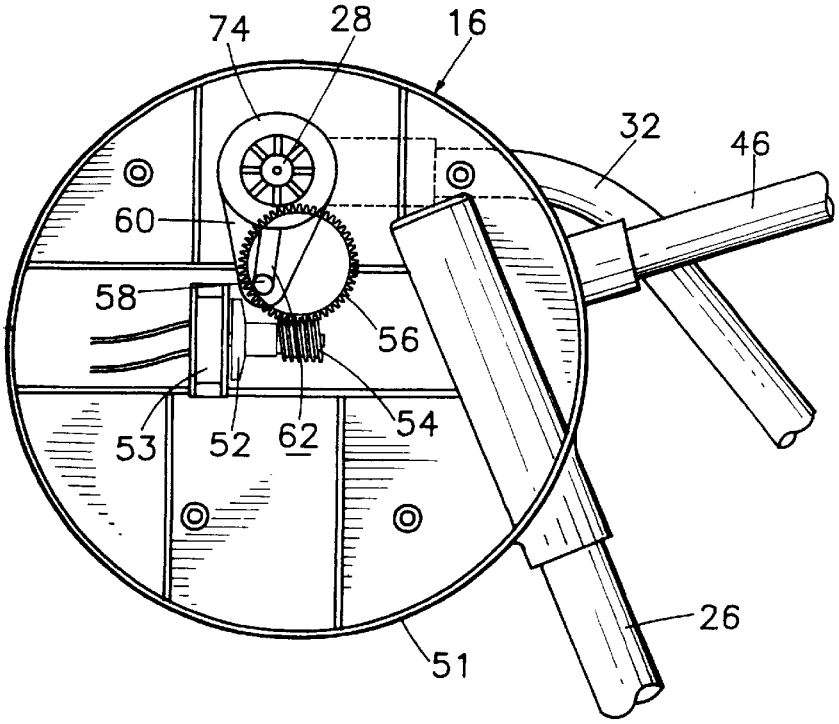
FIG. 6 is a schematic view of the swing drive mechanism adapted in the swing chair in accordance with the present invention, showing a condition corresponding to the forward swung position of the chair.
Figure 7:
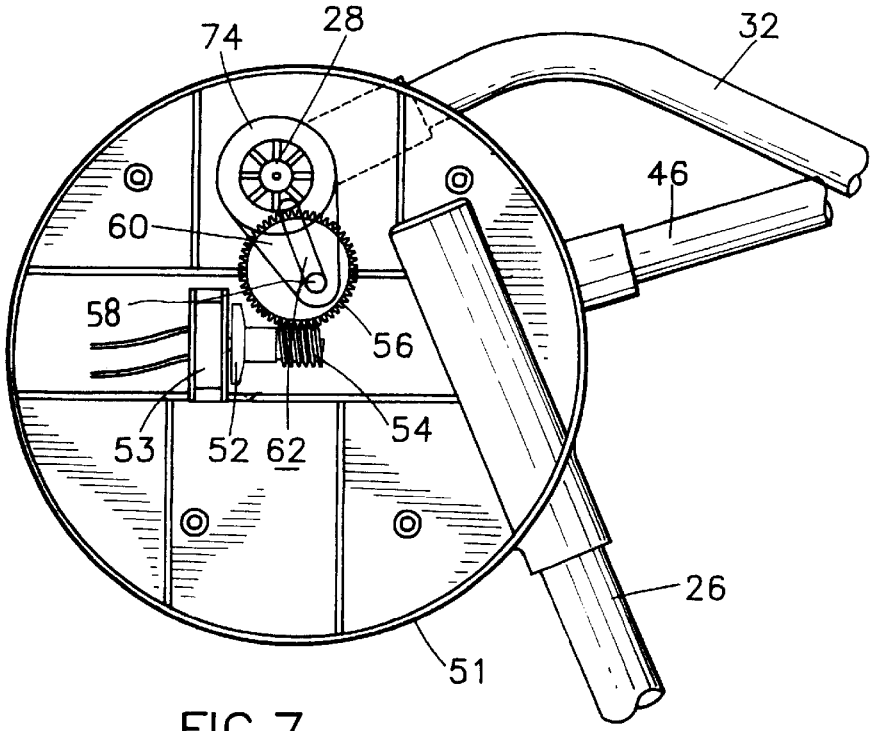
FIG. 7 is a view similar to FIG. 6, but showing a condition corresponding to the rearward swung position of the chair.
Figure 8:
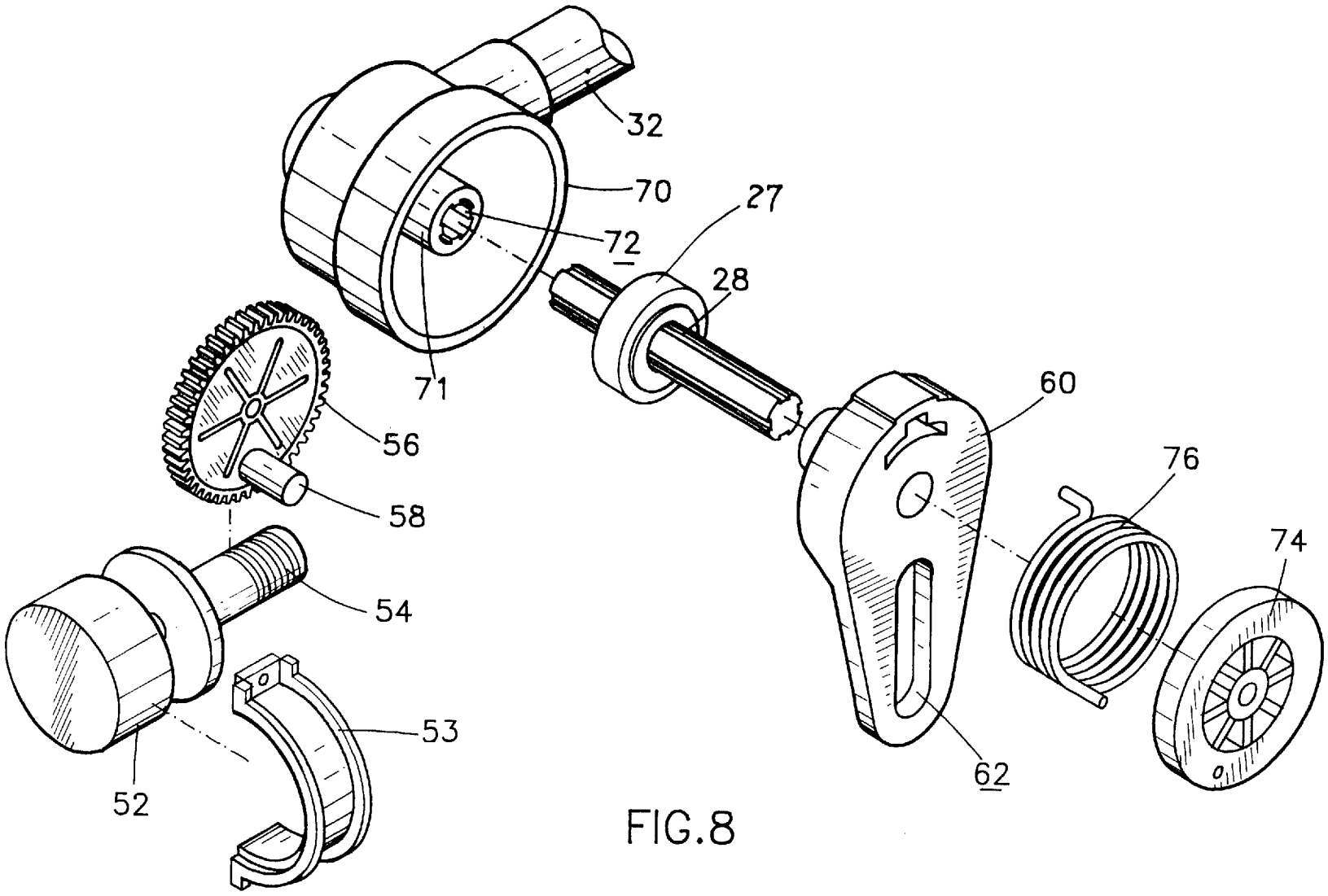
FIG. 8 is an exploded perspective view of the swing drive mechanism adapted in the swing chair in accordance with the present invention.

FIGS. 6 and 7 respectively show the front position and rear position of the swing drive mechanism 16, which correspond to the forward swung position and rearward swung position of the chair 14 shown in FIGS. 4 and 5. With further reference to FIG. 8, the swing drive mechanism 16 comprises a casing 51 fixed to the top end of one of the standing bar members 26 with a torque source 52, such as a motor, fixed therein by means of fastening pieces 53. The motor 52 has an output spindle on which a worm 54 is formed and engageable with a worm gear 56 for speed reduction and change of direction of rotational motion. In the embodiment illustrated, the worm gear 56 is rotatably supported inside the casing 51 by means of a shaft (not shown) which defines a rotational axis of the worm gear 56. The worm gear 56 has an eccentric pin 58 fixed thereon and extending in the direction of shaft so as to orbit about the shaft (rotational axis of the worm gear 56) when the worm gear 56 is driven by the motor 52.

The axle 28 has a link 60 mounted thereon with an elongated slot 62 provided on the link 60 and extending in a direction transverse to the axle 28. The slot 62 is sized to movably receive the pin 58 therein so that when the worm gear 56 is driven by the motor 52, a sliding engagement is formed between the pin 58 and the slot 62. By means of the sliding engagement, the axle 28 is reciprocally swung, in response to the rotation of the worm gear 56, between the forward swung position shown in FIG. 4 and the rearward swung position shown in FIG. 5.

In accordance with a preferred embodiment of the present invention, the arm 32 is provided with a hollow member 70 inside which a collar 71 is rotatably support. The collar 71 is mounted to the arm 32 and has a bore 72 for receiving the axle 28 therein. The link 60 is mounted to the axle 28 so as to allow the axle 28 to rotate with the link 60 when the link 60 is driven by the worm gear 56 and this in turn drives the arm 32 to swing.

A lid 74 is secured to the opening of the hollow member 70 with a torsional spring 76 provided therebetween to serve as cushioning means of the arm 32 which helps preventing sudden change of swinging speed when an external force is applied to the chair and saving power consumption.

Although the invention has been described by means of the preferred embodiment thereof, it is apparent to those skilled in the art that many changes, variation and modifications are possible without departing from the scope of the invention as defined in the appended claims.

What is claimed is:

1. A swing chair comprising a frame structure having a bottom base from which two spaced standing bar members extend upward to each define a top end with a transverse axle mounted thereto for rotatably supporting a pendant arm extending downward therefrom so as to allow the arm to be swingable with respect to the frame, the axles of the standing bar members being arranged to be co-linear to define a rotational axis of the arms; a chair attached to the arms so as to be reciprocally rotatable about the rotational axis between a forward swung position and a rearward swung position with respect to the frame structure; and a swing drive mechanism mounted to the top end of one of the standing bar members, the swing drive mechanism comprising a torque source to provide a rotational motion via an output spindle, a transmission system having an input gear mounted to the output spindle of the torque source and an output gear having an eccentric pin orbitable about rotational axis of the output gear, a link transverse to and mounted to the axle of the one of the standing bar members with an elongated slot formed thereon for movably receiving the eccentric pin therein so as to define a sliding engagement between the pin and the slot which, when the output gear is driven by the torque source, drives the axle via the link to swing the arm and the chair attached to the arm between the forward swung position and the rearward swung position.

2. The swing chair as claimed in claim 1, wherein the torque source comprises a motor.

3. The swing chair as claimed in claim 1, wherein the input gear of the transmission system comprises a worm formed on the output spindle of the torque source and wherein the output gear comprises a worm gear matching the worm with the pin eccentrically mounted thereon.

4. The swing chair as claimed in claim 1, wherein the pendent arms comprise arc members having a horizontally extending section to be received within the respective slot of the chair so as to support the chair thereon.

5. The swing chair as claimed in claim 4, further comprising a cross bar extending and interconnecting between the two pendent arms.

6. The swing chair as claimed in claim 4, further comprising releasable fastening means to releasably secure the chair on the pendent arms.

7. The swing chair as claimed in claim 1, wherein the frame structure comprises a bottom base framework comprising two side bar members having rear ends with a rear bar members interconnecting therebetween to define two rear joints from which the two standing bar members respectively extend.

8. The swing chair as claimed in claim 7, wherein the bottom base framework further comprises a front bar member interconnecting between front ends of the side bar members which are opposite to the rear ends.

9. The swing chair as claimed in claim 7, wherein the top ends of the standing bar members are inclined toward the front ends of the side bar members.

10. The swing chair as claimed in claim 1, wherein the swing drive mechanism comprises a casing fixed to the top end of the one of the standing bar members inside which a torsional spring is provided between the casing and the axle to serve as a cushion therebetween.

* * * * *